US009574426B2

(12) United States Patent
Cain et al.

(10) Patent No.: US 9,574,426 B2
(45) **Date of Patent: *Feb. 21, 2017**

(54) OFFSHORE WELL SYSTEM WITH A SUBSEA PRESSURE CONTROL SYSTEM MOVABLE WITH A REMOTELY OPERATED VEHICLE

(71) Applicant: Cameron International Corporation, Houston, TX (US)

(72) Inventors: David E. Cain, Katy, TX (US); Shian J. Chou, Houston, TX (US); Vijay A. Cheruvu, Houston, TX (US); William F. Puccio, Katy, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/871,718

(22) Filed: Sep. 30, 2015

(65) Prior Publication Data

US 2016/0024892 A1 Jan. 28, 2016

Related U.S. Application Data

(63) Continuation of application No. 13/838,977, filed on Mar. 15, 2013, now Pat. No. 9,187,973.

(51) Int. Cl.

| | |
|---|---|
| ***E21B 17/01*** | (2006.01) |
| ***E21B 33/038*** | (2006.01) |
| ***E21B 33/035*** | (2006.01) |
| ***E21B 41/04*** | (2006.01) |
| ***E21B 41/00*** | (2006.01) |
| ***E21B 17/02*** | (2006.01) |
| ***E21B 33/064*** | (2006.01) |

(52) U.S. Cl.

CPC ..... *E21B 41/04* (2013.01); *E21B 17/01* (2013.01); *E21B 17/02* (2013.01); *E21B 33/038* (2013.01); *E21B 33/064* (2013.01); *E21B 41/0007* (2013.01)

(58) Field of Classification Search

None

See application file for complete search history.

(56) References Cited

U.S. PATENT DOCUMENTS

| | | | |
|---|---|---|---|
| 4,193,455 | A | 3/1980 | Steddum et al. |
| 4,880,025 | A | 11/1989 | McMahan, Jr. et al. |
| 5,069,580 | A | 12/1991 | Herwig et al. |
| 5,097,780 | A | 3/1992 | Winchester |
| 6,155,748 | A | 12/2000 | Allen et al. |

(Continued)

*Primary Examiner* — Matthew R Buck
*Assistant Examiner* — Douglas S Wood
(74) *Attorney, Agent, or Firm* — Chamberlain Hrdlicka

(57) ABSTRACT

An offshore well drilling system for drilling a subsea well is presented that includes a floating platform, a surface BOP stack, a riser, and a driveable environmental safe guard system. The safe guard system includes an upper wellhead connector, a lower wellhead connector, a blowout preventer with shearing blind rams, and a subsea pressure control system. The subsea pressure control system can be electric, hydraulic, acoustic, or ROV actuated. More importantly, the environmental safeguard system is moveable, and can be driven around using as ROV. The present invention provides swift disconnect and recovery for emergency situations. The subsea environmental safe guard system is also much lighter in weight than traditional subsea stacks.

19 Claims, 4 Drawing Sheets

(56) References Cited

U.S. PATENT DOCUMENTS

| | | | | |
|---|---|---|---|---|
| 6,622,799 | B2 * | 9/2003 | Dean | E21B 33/038 166/339 |
| 6,845,815 | B2 | 1/2005 | Hergarden et al. | |
| 7,513,308 | B2 | 4/2009 | Hosie et al. | |
| 7,690,433 | B2 | 4/2010 | Reynolds | |
| 7,779,917 | B2 | 8/2010 | Kotria et al. | |
| 7,891,429 | B2 * | 2/2011 | Boyce | E21B 7/124 166/338 |
| 9,010,431 | B2 * | 4/2015 | Billington | E21B 19/002 166/250.01 |
| 9,187,973 | B2 * | 11/2015 | Cain | E21B 33/038 |
| 2008/0251257 | A1 | 10/2008 | Leuchtenberg | |
| 2008/0302536 | A1 | 12/2008 | Kotria et al. | |
| 2014/0262309 | A1 | 9/2014 | Cain et al. | |

* cited by examiner

OFFSHORE WELL SYSTEM WITH A SUBSEA PRESSURE CONTROL SYSTEM MOVABLE WITH A REMOTELY OPERATED VEHICLE

BACKGROUND

Drilling and producing offshore oil and gas wells includes the use of offshore platforms for the exploitation of undersea petroleum and natural gas deposits. In deep water applications, floating platforms (such as spars, tension leg platforms, extended draft platforms, and semi-submersible platforms) are typically used. One type of offshore platform, a tension leg platform ("TLP"), is a vertically moored floating structure used for offshore oil and gas production. The TLP is permanently moored by groups of tethers, called a tension legs or tendons, which eliminate virtually all vertical motion of the TLP due to wind, waves, and currents. The tendons are maintained in tension at all times by ensuring net positive TLP buoyancy under all environmental conditions. The tendons stiffly restrain the TLP against vertical offset.

The offshore platforms typically support risers that extend from one or more wellheads or structures on the seabed to the platform on the sea surface. The risers connect the subsea well with the platform to protect the fluid integrity of the well and to provide a fluid conduit to and from the wellbore. During drilling operations, a drilling riser is used to maintain fluid integrity of the well. After drilling is completed, a production riser is installed.

As drilling rigs venture into ever increasing water depths and encounter new challenges, well control has become increasingly problematic. As costs of floating mobile offshore drilling units escalate, traditional time-intensive operations are constantly being re-evaluated in an effort to reduce overall non-drilling time, thereby increasing the drilling efficiency of the rig. With the economic pressures facing the oil industry today, it has become even more important to provide cost-effective alternatives to traditional drilling/well control methods.

Traditionally, offshore drilling is done either with a floating vessel, utilizing a subsea blowout preventer (BOP) stack, with full control and drilling riser systems or with a jackup or platform utilizing a surface BOP stack and controls. These methods could be viewed as safe and reliable, but not always the most cost effective. There are also concerns with other traditional control methods. For instance, another method utilizes a floating vessel with surface BOPs in place of subsea BOPs. High-pressure riser is run from the surface BOPs to the sea floor where it is cemented in place. This means that the rig is essentially cemented in place, allowing no practical means of disconnecting in the event of an emergency. Also, if anything damages the high-pressure riser while drilling, fluids in the riser escape to the environment.

BRIEF DESCRIPTION OF THE DRAWINGS

A better understanding of the various disclosed system and method embodiments can be obtained when the following detailed description is considered in conjunction with the drawings, in which.

DETAILED DESCRIPTION

Figure 1:
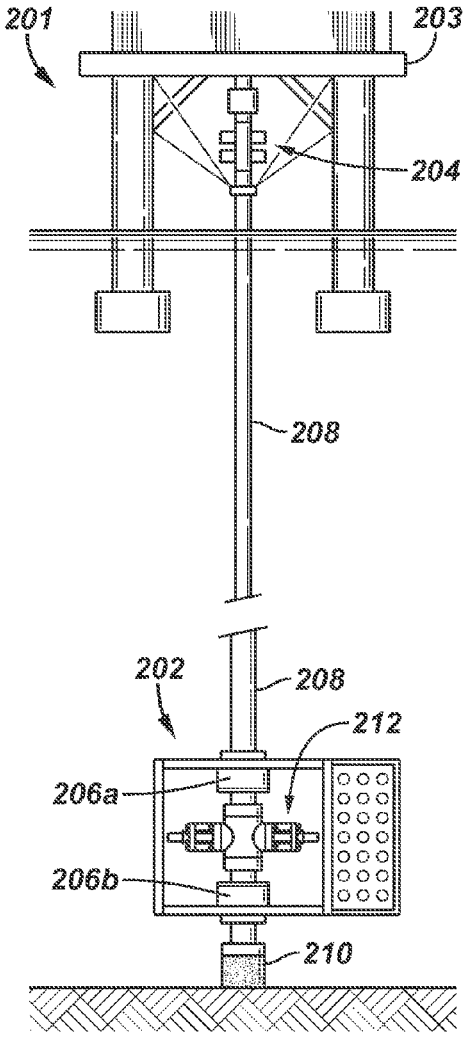
FIG. 1 is an illustrative embodiment of a subsea pressure control system.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Accordingly, disclosed herein is an offshore well system for subsea drilling. Some embodiments for this system include a floating platform, a surface blowout preventer (BOP) stack, a riser connecting the well with the platform, and a moveable (or driveable) subsea pressure control system. The subsea pressure control system includes a subsea BOP, which may include shearing blind rams, as well as upper and lower wellhead collet connectors. The subsea pressure control system may also be referred to as an environmental safeguard system, or ESG system. The subsea pressure control system also includes a subsea control system that may be an acoustic, electric, ROV, or hydraulic actuated control system.

The subsea pressure control system is a driveable system that can be transported using an ROV. Some embodiments may include an ROV with a buoyancy mechanism. Other embodiments may include a subsea pressure control system attached to a separate object with buoyancy. The embodiments of the presented system will also work with modern components of a floating platform, including a triple barrel telescoping joint that connects the surface BOP stack to the floating platform, and even a motion compensation system connected to the floating platform.

Method embodiments for the present invention include connecting a surface BOP stack to a platform, connecting a riser system to the surface BOP, and installing a subsea pressure control system to the riser system. The subsea pressure control system includes an upper and lower wellhead connector, a BOP, and a subsea pressure control system. The subsea pressure control system is connected to a wellsite where the subsea well is being drilled. The method embodiment may also include closing the BOP of the subsea pressure control system to close off the well, disconnecting the subsea pressure control system from the well, and moving the riser system along with the subsea pressure control system from the first wellsite to a second wellsite using an ROV.

Another method embodiment for disconnection includes closing the subsea BOP, disconnecting the riser system, and moving the floating platform and riser to a safer location. The subsea pressure control system may remain attached to the well or may be taken along with the riser to safer location.

FIG. 1 shows an embodiment of an offshore well system 201 with a subsea pressure control system 202, which may be used for drilling operations. In the well system 201, surface pressure control equipment such as blowout preventers (BOPs) 204 are located on a floating platform 203 and connected to a riser system 208. The subsea pressure control system 202, while not the size of a full-size traditional subsea BOP stack 204, may be used for BOP functions such as sealing the well and also for disconnecting the riser from the subsea well while the surface BOP unit 204 handles the main pressure control functions during drilling operations. Because it does not include a full BOP stack, the subsea pressure control system can weigh anywhere from 60,000-80,000 thousand pounds, compared to 650,000 pounds or more for other traditional subsea BOP stacks. The reduced size and weight enables the use of a second or third generation rig, even in deep water. The subsea pressure control system 202 includes an appropriate riser connector 206*a* and wellhead connector 206*b* for connecting to the riser 208 and the subsea wellhead 210. The connectors 206*a* and 206*b* may be collet connectors operated hydraulically or by any other suitable means. The subsea pressure control system 202 also includes a ram-type BOP 212 with shearing blind rams and a subsea control system. The subsea control system may be, for example, an acoustic, electric, ROV-actuated, hydraulic control system, or any other suitable control system for operating the subsea pressure control system 202.

In the event of a situation where the platform is moved from the well site without time to shut in a well, the control system is used to signal the subsea pressure control system BOP 212 to shear the drill pipe in the riser system 208 extending into the well. Once the shearing blind rams shear and seal off the bore, the control system is used to signal the upper connector to the riser system 208 to disconnect, allowing the platform to be moved off location with the riser 208 attached. Alternatively, if there is no pipe inside the subsea pressure control system 202 and the well has been contained using other appropriate barriers, the subsea pressure control system 202 may disconnect from the subsea wellhead 210 by disconnecting the lower connector while remaining attached to the riser system 208. The subsea pressure control system 202 may then either travel with the riser system 208 off site or simply be moved to the next well ready for drilling.

Figure 2:
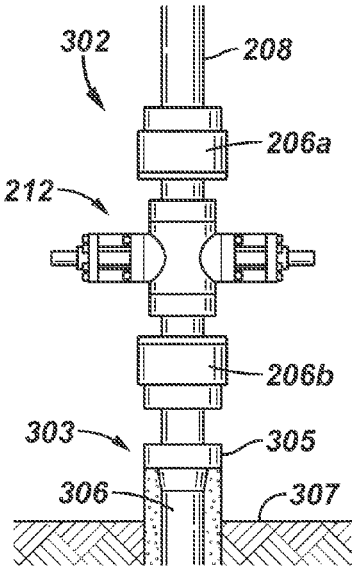
FIG. 2 is a more detailed, illustrative view of a component of the subsea pressure control system.

FIG. 2 shows an example of components of a subsea pressure control system 302 for various embodiments. As shown, the subsea well 303 extends into the sea floor 307. Well casing 306 is cemented in place and supported by a wellhead 305. The wellhead 305 is the component at the surface of an oil or gas well that provides the structural and pressure-containing interface for the drilling and production equipment. The connectors 206*a* and 206*b* may be collet connectors which may be operated hydraulically, electrically, or by any other suitable means. As shown, the riser 208 is connected to the subsea pressure control system 302 using the connector 206*b*. The subsea pressure control system 302 also includes a BOP 212 with shearing blind rams 212 installed into the system. The shearing blind rams are capable of shearing drill pipe extending through the module 302 and sealing the subsea well.

Figure 3:
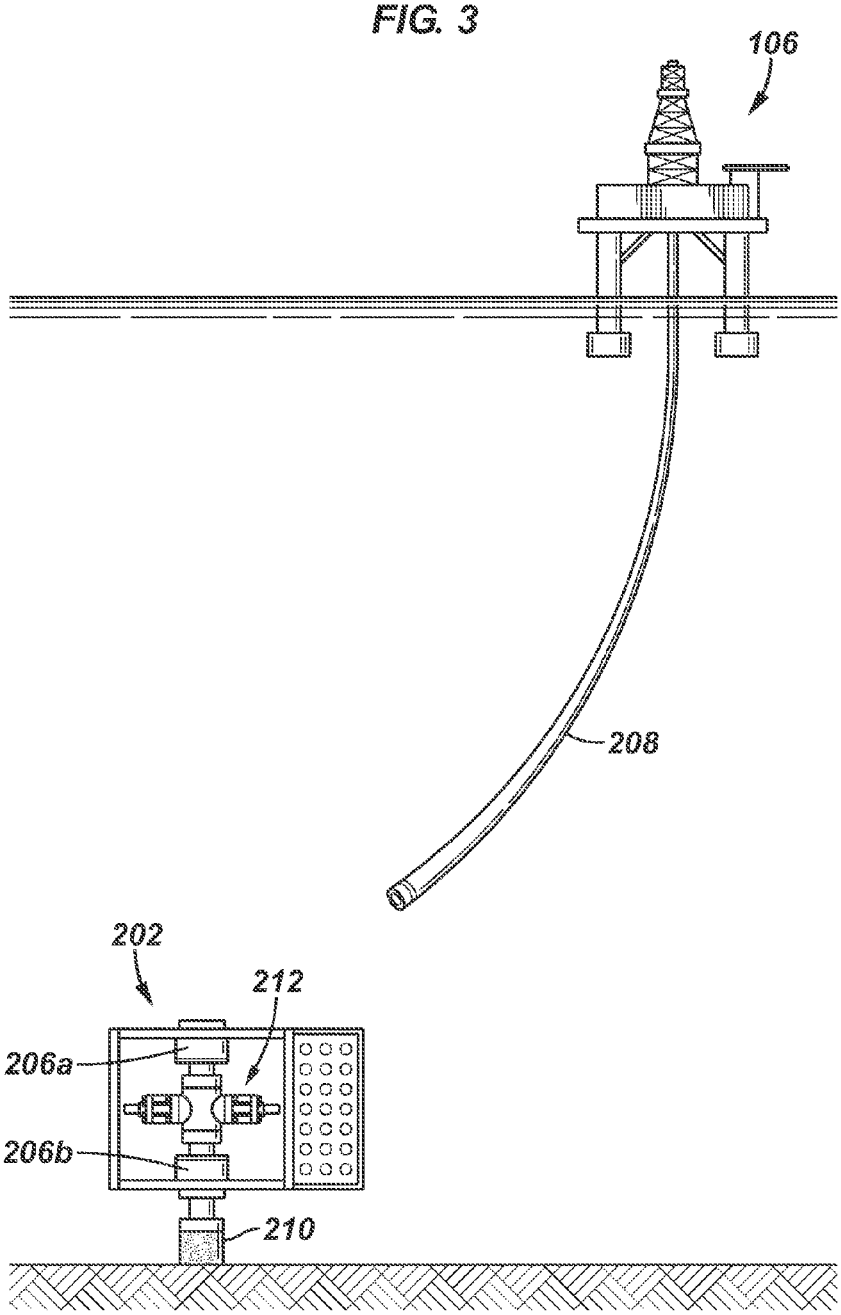
FIG. 3 shows a swift disconnection of the subsea pressure control system in an emergency situation.

As shown in FIG. 3, in the event of an emergency situation where the platform needs to be moved from the well site, the control system on the platform is used to signal the subsea pressure control system BOP 212 to shear the pipe in the riser system 208. Once the shearing blind rams shear the pipe and seal off the well, the subsea pressure control system is used to signal disconnection of the riser connector 206*a*, which allows the platform to be moved off location with the drilling riser 208 attached, leaving the subsea system in place on the sealed well. In other embodiments, alternatively, if there is no pipe inside the subsea pressure control system 202 and the well has been contained using other appropriate barriers, the subsea pressure control system 202 may disconnect from the subsea wellhead 210 by disconnecting the wellhead connector 206*b* while remaining attached to the riser 208. The subsea pressure control system 202 may then either travel with the riser 208 off site or simply be moved to the next well ready for drilling.

Figure 4:
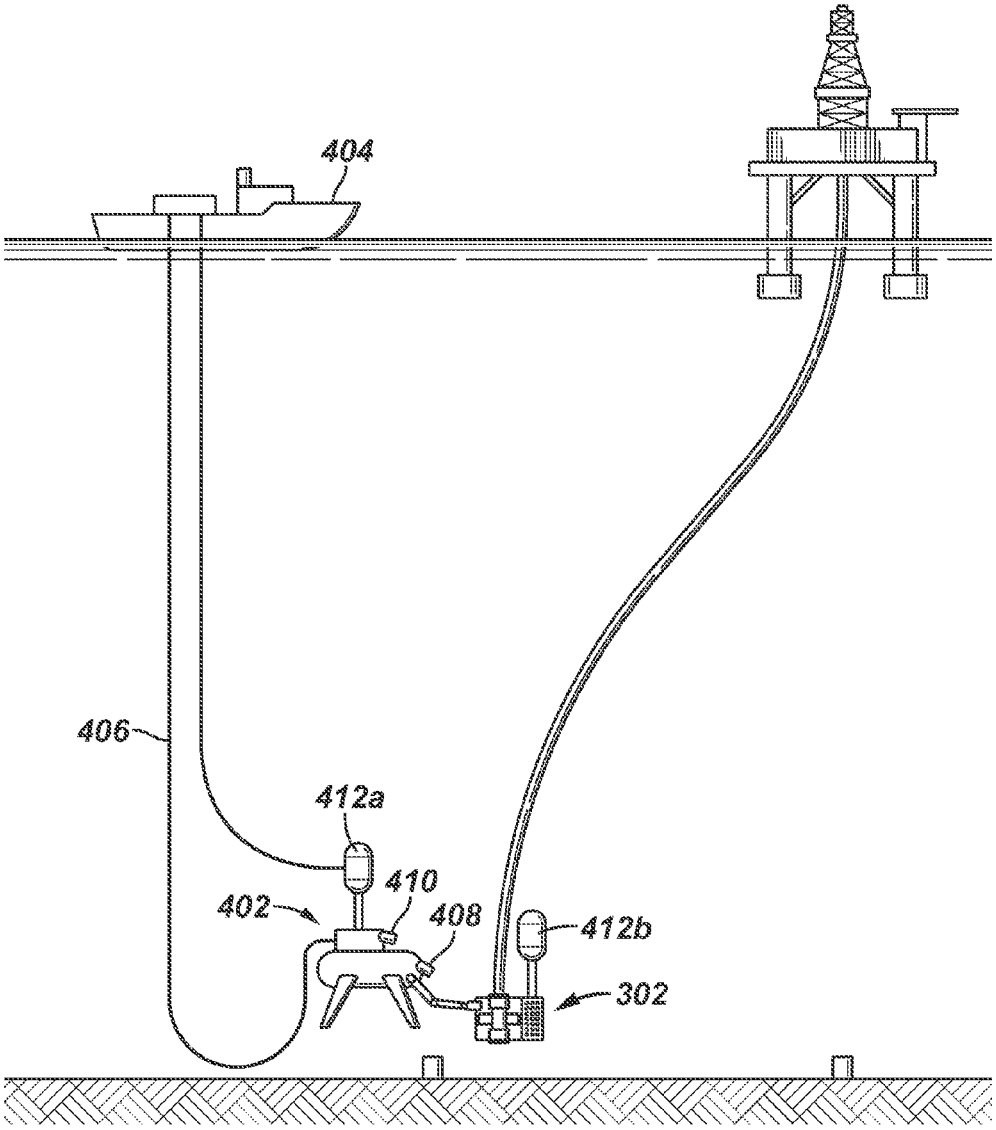
FIG. 4 shows the subsea pressure control system being driven by a remotely operated vehicle (ROV)

According to FIG. 4, another embodiment of the invention uses an ROV 502 to move or drive the subsea pressure control system 302 to a different subsea location, with the ability of leaving the riser system attached. However, it should be appreciated that the riser system need not be moved with the ROV. In this embodiment, the subsea pressure control system 302 is disconnected from the wellhead, and driven away using an ROV 402 with the riser attached during the process. The ROV 402 in this embodiment can be operated by a person aboard a vessel or ship 404. The ship 404 and the ROV 402 are linked by a tether 406—a group of cables that carry electrical power, video, and data signals back and forth between the operator and the vehicle. High power applications will often use hydraulics in addition to electrical cabling. Most ROVs will be equipped with lights 408 and a video camera 410 to assist with navigation and operation.

Although the subsea pressure control system 302 is relatively light weight and weighs less than traditional subsea pressure control systems such as subsea BOP stacks, the subsea pressure control system can still weigh anywhere from 60,000-80,000 lbs. Consequently, the weight of the subsea pressure control system 302 makes it difficult to move around. Thus, another embodiment can use an ROV that is equipped with a buoyancy system, such as an air can 412*a*, to help offset the heavy weight of the subsea pressure control system. Another embodiment can have the subsea pressure control system 302, itself equipped with a buoyancy system. Yet another embodiment may have both the subsea pressure control system 302 and the ROV equipped with a buoyancy system, such as air cans 412*a* and 412*b*. There are multiple options that can be used for buoyancy devices. For example, air cans, foam components, or a combination of both air cans and foam components may be used.

Figure 5:
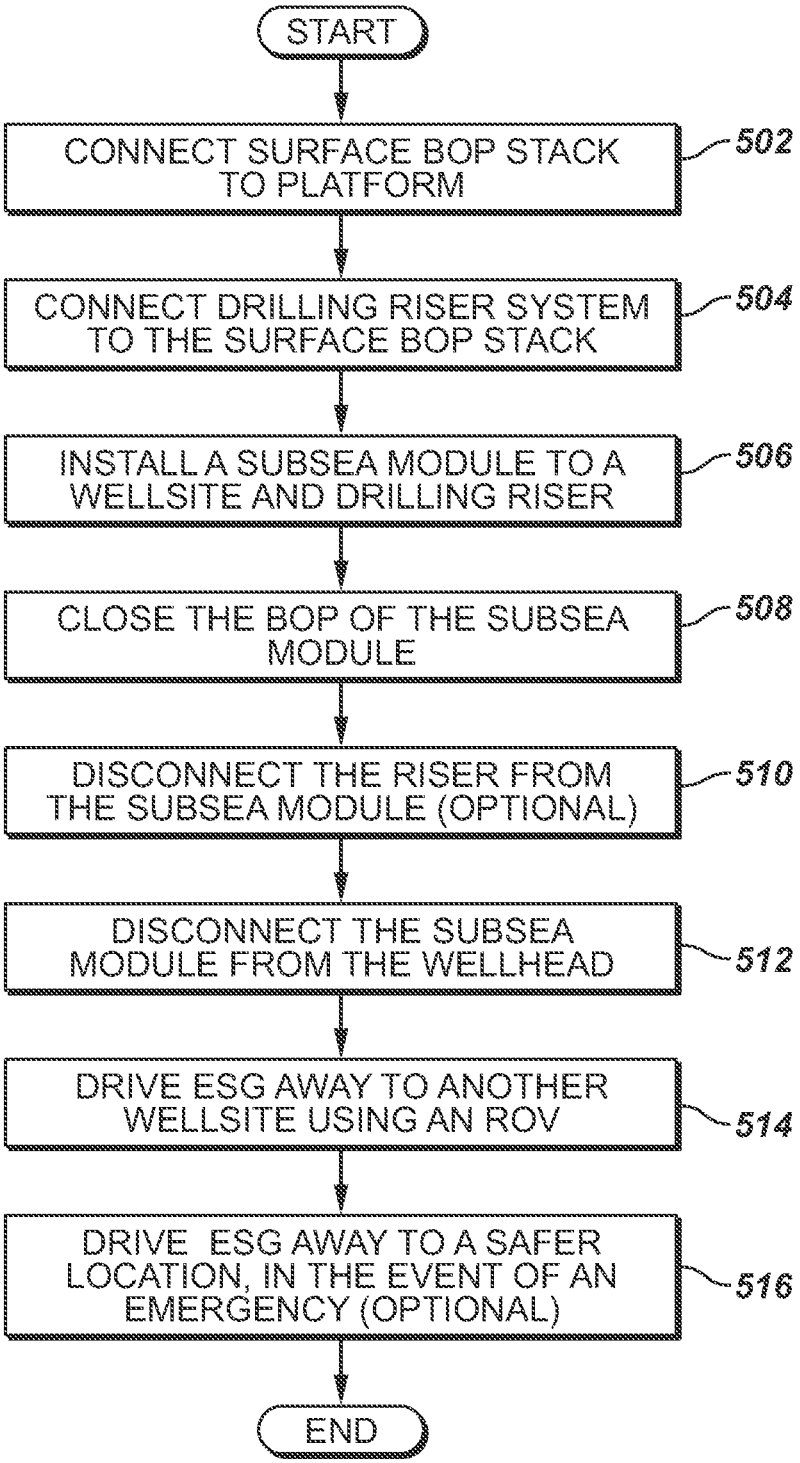
FIG. 5 shows a diagram of an illustrative method embodiment for completion of the presented subsea pressure control system.

FIG. 5 is a diagram of an illustrative method embodiment. In block 502, a surface BOP stack is connected to a floating platform, and a riser is connected to the surface BOP in block 504. Next, the subsea pressure control system is installed, as indicated in block 506. Whenever necessary, this system provides the flexibility to close the BOP of the subsea pressure control system, as shown in block 508, and disconnect the riser from the subsea pressure control system (block 510). If is desired to navigate or relocate the subsea pressure control system also, the subsea pressure control system can be disconnected from the wellsite instead, as shown in block 512. Finally, the ESG can be driven away, by the ROV, to another wellsite (block 514) or to a safer location in the event of an emergency (block 516).

There are multiple advantages to the presented invention. The combination of surface and subsea pressure control systems allows for greater protection from problems faced with offshore drilling. The subsea pressure control systems described above provide flexibility in operation, as well as movement above and below the surface. Further, the subsea pressure control system weighs much less than the traditional subsea stacks, and allows for easy disconnect at either the riser or wellhead connectors. The system presented also allows for quick and safe evacuation from a well location. Wells used with this system can be quickly shut-in at the sea floor and disconnected from the riser or casing above it. The ROVs used in most embodiments of this system allow for even more flexibility by navigating the subsea pressure control systems below the surface. Most embodiments can operate in water depths of at least 10,000 ft. Thus, this system will help reduce overall non-drilling time, and increase the drilling efficiency of the rig.

Other embodiments can include alternative variations. These and other variations and modifications will become apparent to those skilled in the art once the above disclosure is fully appreciated. It is intended that the following claims be interpreted to embrace all such variations and modifications.

What is claimed is:

1. An offshore well system for a subsea well with a subsea wellhead, including:
- a floating platform;
- a surface blowout preventer ("BOP") at the floating platform;
- a riser extending subsea from the platform in fluid communication with the surface BOP; and
- a subsea pressure control assembly including:
  - a riser connector connectable to the subsea riser;
  - a wellhead connector connectable to the subsea wellhead;
  - a subsea pressure control device; and
  - a control system configured to operate the riser connector, the wellhead connector, and the subsea pressure control device; and
- wherein the subsea pressure control assembly is configured to be transported intact by a remotely operated vehicle (ROV).

2. The well system of claim 1, wherein the control system is at least one of an acoustic, electric, hydraulic, or ROV actuated control system.

3. The well system of claim 1, wherein the subsea pressure control device includes at least one of a BOP or a gate valve.

4. The well system of claim 1, wherein the ROV includes a buoyancy system.

5. The well system of claim 4, wherein the buoyancy system includes at least one of an air can and foam.

6. The well system of claim 1, wherein the subsea pressure control assembly includes a buoyancy system.

7. The well system of claim 6, wherein the buoyancy system includes at least one of an air can and foam.

8. The well system of claim 1, further comprising:
- a triple barrel telescoping joint that connects the surface BOP to the floating platform; and
- a motion compensation system connected to the floating platform.

9. A method for constructing wells at a wellsite, that comprises:
- connecting a surface blowout preventer (BOP) to a floating platform;
- connecting a riser in fluid communication with the surface BOP;
- connecting a subsea pressure control assembly to the riser, wherein the subsea pressure control assembly includes a subsea pressure control device;
- connecting the subsea pressure control assembly with a first well to establish fluid communication between the first well and the riser;
- disconnecting the subsea pressure control assembly from the first well;
- moving the subsea pressure control assembly to a second well at a second wellsite by a remotely operated vehicle (ROV); and
- connecting the subsea pressure control assembly to the second well.

10. The method of claim 9, further comprising closing the subsea pressure control device.

11. The method of claim 9, wherein connecting the subsea pressure control assembly with the riser includes operating collet connectors connected to the subsea pressure control device.

12. The method of claim 9, wherein the subsea pressure control assembly comprises a control system including at least one of an acoustic, electric, hydraulic, or ROV actuated control system.

13. A subsea pressure control assembly, including:
- a riser connector connectable to a subsea riser;
- a wellhead connector connectable to a subsea wellhead;
- a subsea pressure control device; and
- a control system configured to operate the riser connector, the wellhead connector, and the subsea pressure control device; and
- wherein the subsea pressure control assembly is configured to be transported intact by a remotely operated vehicle (ROV).

14. The subsea pressure control assembly of claim 13, further comprising at least one of an acoustic, electric, hydraulic, or ROV actuated control system.

15. The subsea pressure control assembly of claim 13, wherein the subsea pressure control device includes at least one of a BOP or a gate valve.

16. The subsea pressure control assembly of claim 13, wherein the ROV includes a buoyancy system.

17. The subsea pressure control assembly of claim 16, wherein the buoyancy system includes at least one of an air can and foam.

18. The subsea pressure control assembly of claim 13, further comprising a buoyancy system.

19. The subsea pressure control assembly of claim 18, wherein the buoyancy system includes at least one of an air can and foam.

* * * * *